US012329265B2

(12) United States Patent
Yan et al.

(10) Patent No.: US 12,329,265 B2
(45) Date of Patent: Jun. 17, 2025

(54) COSMETIC PRODUCT CONTAINER AND RETENTION MECHANISM

(71) Applicant: ELC MANAGEMENT LLC, Melville, NY (US)

(72) Inventors: Jian Yan, Kirkland (CA); Miguel Alberto Herrera, Doylestown, PA (US)

(73) Assignee: ELC MANAGEMENT LLC, Melville, NY (US)

( * ) Notice: Subject to any disclaimer, the term of this patent is extended or adjusted under 35 U.S.C. 154(b) by 333 days.

(21) Appl. No.: 17/891,622

(22) Filed: Aug. 19, 2022

(65) Prior Publication Data

US 2024/0057742 A1 Feb. 22, 2024

(51) Int. Cl.
*A45D 40/02* (2006.01)
*A45D 40/00* (2006.01)

(52) U.S. Cl.
CPC .... *A45D 40/023* (2013.01); *A45D 2040/0025* (2013.01); *A45D 2040/0062* (2013.01)

(58) Field of Classification Search
CPC ..... A45D 40/02; A45D 2040/0062; A45D 2040/0025; A45D 40/023
USPC ..... 401/88
See application file for complete search history.

(56) References Cited

U.S. PATENT DOCUMENTS 2,368,045 A * 1/1945 Jensen ..... A45D 40/02 401/82
5,865,550 A * 2/1999 Bouix ..... A45D 40/06 401/86
5,888,004 A * 3/1999 Bouix ..... A45D 40/04 401/98
8,210,347 B2 7/2012 McLaughlin
9,113,693 B2 8/2015 Yan
9,820,550 B2 11/2017 Heraud
11,896,110 B2 2/2024 Suzuki et al.
(Continued)

FOREIGN PATENT DOCUMENTS

CN 102740728 A 10/2012
CN 102858652 A 1/2013
(Continued)

OTHER PUBLICATIONS

International Application No. PCT/US2023/028730, International Search Report and Written Opinion, mailed Nov. 15, 2023.
(Continued)

*Primary Examiner* — David J Walczak
(74) *Attorney, Agent, or Firm* — MARSHALL, GERSTEIN & BORUN LLP

(57) ABSTRACT

A cosmetic product includes a cup and a cosmetic substance. The cup has a cup body including first and second ends and forming a cup cavity and a liner at least partially disposed within the cup cavity that includes first and second ends and an inner sidewall forming a liner cavity. The liner is constructed from a swellable material. The cosmetic substance has first and second ends and an elongated body therebetween. At least a portion of the elongated body is disposable within the liner cavity and contacts a portion of the inner sidewall. Upon disposing at least a portion of the cosmetic substance within the liner cavity, the liner is adapted to swell in a direction toward the cosmetic substance to apply a retaining force thereto.

17 Claims, 4 Drawing Sheets

(56) References Cited

U.S. PATENT DOCUMENTS

| | | | | |
|---|---|---|---|---|
| 2013/0015089 | A1* | 1/2013 | McLaughlin | A45D 40/00 206/385 |
| 2013/0075301 | A1 | 3/2013 | McLaughlin | |
| 2018/0070703 | A1 | 3/2018 | Kikuchi et al. | |
| 2022/0053913 | A1 | 2/2022 | Zheng et al. | |
| 2022/0183445 | A1* | 6/2022 | Suzuki | B65D 53/02 |
| 2023/0363513 | A1 | 11/2023 | Wightman et al. | |

FOREIGN PATENT DOCUMENTS

| | | | |
|---|---|---|---|
| CN | 108851469 | A | 11/2018 |
| CN | 111543769 | A | 8/2020 |
| CN | 211510835 | U | 9/2020 |
| CN | 214432512 | U | 10/2021 |
| CN | 113631061 | A | 11/2021 |
| EP | 0894453 | A2 | 2/1999 |
| FR | 3074023 | A1 | 5/2019 |
| JP | 2013180037 | A | 9/2013 |
| JP | 2017136307 | A | 8/2017 |
| TW | 202228547 | A | 8/2022 |
| WO | WO-2007043092 | A1 | 4/2007 |
| WO | WO-2014001762 | A1 | 1/2014 |

OTHER PUBLICATIONS

International Application No. PCT/US2023/028736, International Search Report and Written Opinion, mailed Nov. 16, 2023.

* cited by examiner

COSMETIC PRODUCT CONTAINER AND RETENTION MECHANISM

FIELD OF THE DISCLOSURE

The present disclosure generally relates to cosmetic, hair care, body care, and/or skincare products and, more particularly, to systems and approaches for containing and retaining such products.

BACKGROUND

Cosmetic, hair care, body care, and/or skincare products may be provided in a number of different containers, and may be applied using a number of varying approaches. As an example, a lipstick or lip balm product may be in the form of an elongated tube or cylinder that is disposed in a protective container. Such containers may allow the cosmetic substance to selectively advance to an extended position relative to the container to be applied by the user. The cosmetic substance may be a generally solid, yet relatively soft, molded composition that may be inserted into a cavity of a retaining cup. In the event the container is inadvertently dropped or otherwise jostled, the cosmetic substance may become damaged, broken, or otherwise detached from the retaining cup. In some examples, the retaining cup (or other features of the container) may include discrete retention members in the form of hooks, elongated ribs, or similar components that may be urged into the cosmetic substance in an attempt to prevent or otherwise limit movement of the cosmetic substance relative to the cup and the container during these inadvertent drops or bumps. However, these features may create localized stress points that may ultimately deform or otherwise damage the cosmetic substance.

Accordingly, there is a need for improved accessories having improved functionalities.

SUMMARY

Examples within the scope of the present disclosure are directed to a cosmetic product container and retention mechanism that may include a cup and a cosmetic substance. The cup has a cup body including first and second ends and forming a cup cavity and a liner at least partially disposed within the cup cavity that includes first and second ends and an inner sidewall forming a liner cavity. The liner is constructed from a swellable material. The cosmetic substance has first and second ends and an elongated body therebetween. At least a portion of the elongated body is disposable within the liner cavity and contacts a portion of the inner sidewall. Upon disposing at least a portion of the cosmetic substance within the liner cavity, the liner is adapted to swell in a direction toward the cosmetic substance to apply a retaining force thereto In an approach, the product further includes an outer container having first and second ends and defining a container cavity. The cup is at least partially disposable within the container cavity.

In these and other approaches, the liner may be constructed from one of polyolefin, a synthetic rubber material including ethylene, propylene, and diene monomers (EPDM), or silicone rubber. In some of these examples, the liner may be bi-injected with the cup body. The cup body may be formed from a second, non-swelling material. In other examples, the liner may be separately formed and operably coupled with the cup body.

In some examples, the liner may surround an entire outer circumferential section of the cosmetic substance. In some of these forms, the liner may include an elongated retention member disposed on the inner sidewall of the liner that extends into the liner cavity. In these and other approaches, a cup retention member may be provided that is disposed on an outer surface of the cup body. The cup retention member may be aligned with the elongated retention member. Further, the cup retention member may apply an urging force towards the cup cavity upon inserting the cup into the container cavity.

In some approaches, the liner may further include a floor member positioned at or near the first end thereof. The first end of the cosmetic substance may abut the floor member.

In accordance with a second aspect, a retention mechanism for retaining a cosmetic substance includes a cup body having first and second ends and forming a cup cavity, and a liner at least partially disposed within the cup cavity. The liner includes first and second ends and an inner sidewall forming a liner cavity and is constructed from a swellable material. The liner swells upon a cosmetic substance being placed within the liner cavity such that the liner applies a retaining force on the cosmetic substance to retain the cosmetic within the liner cavity.

In accordance with a third aspect, an approach for assembling a cosmetic product includes providing a cup including a cup body having first and second ends and forming a cup cavity and a liner at least partially disposed within the cup cavity. The liner includes first and second ends and an inner sidewall forming a liner cavity and is constructed from a swellable material. The approach further includes providing a cosmetic substance having a first end, a second end, and an elongated body therebetween and disposing at least a portion of the elongated body of the cosmetic substance within the liner cavity such that the cosmetic substance contacts a portion of the inner sidewall. In response to the cosmetic substance contacting a portion of the inner sidewall, the liner swells in a direction toward the cosmetic substance to apply a retaining force thereto.

BRIEF DESCRIPTION OF THE DRAWINGS

The above needs are at least partially met through provision of one, more than one, or any combination of the cosmetic product containers and retention mechanisms described in the following detailed description, particularly when studied in conjunction with the drawings, wherein.

Figure 1:
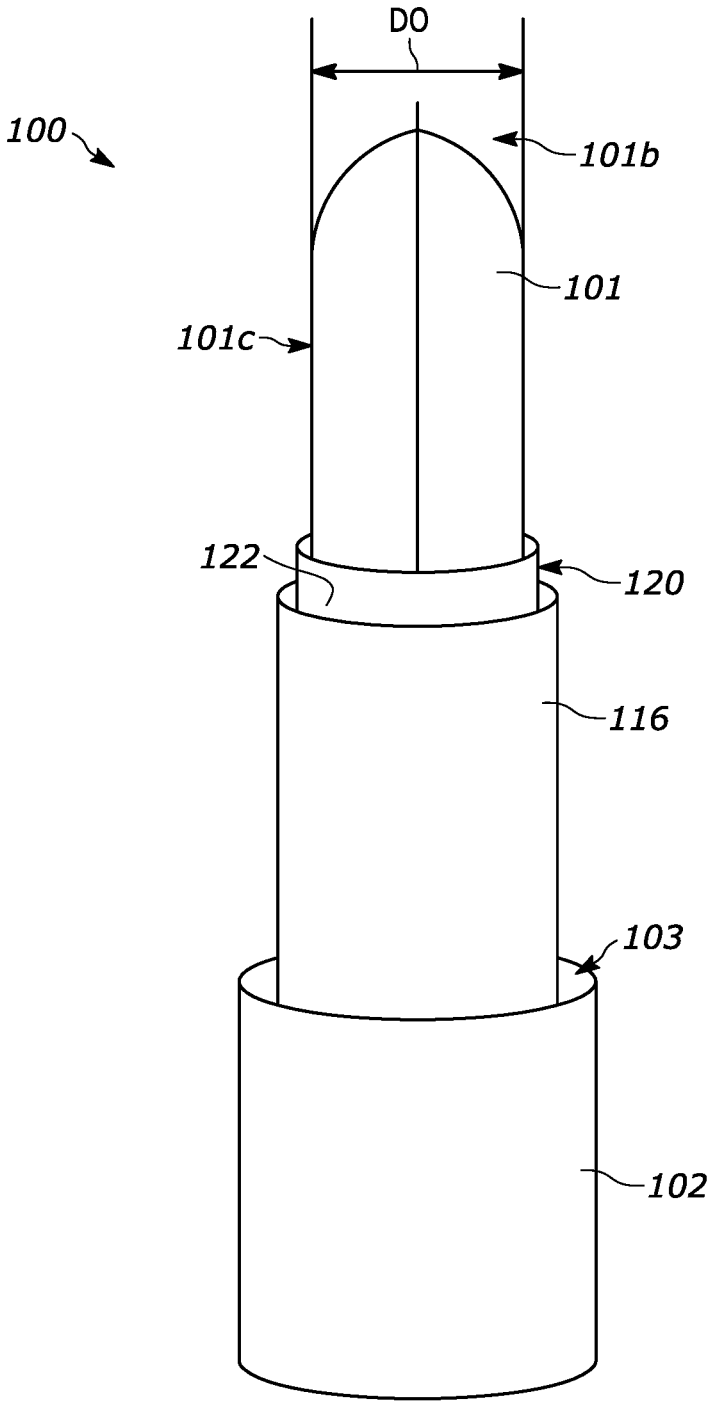
FIG. 1 illustrates a front elevation view of an example cosmetic product in accordance with various examples.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples. Also, common but well-understood elements that are useful or necessary in a commercially feasible examples are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various approaches, cosmetic product containers and retention mechanisms are provided that adequately retain a cosmetic substance during use as well as in the event of inadvertent drops and/or bumps. The approaches described herein provide firm retention of the cosmetic substance while reducing or eliminating potentially harmful stress regions. As such, the systems described herein may be used to contain and retain a multitude of cosmetic substances having varying degrees of material softness.

Turning to the Figures, a cosmetic product 100 is provided for containing and applying a cosmetic substance 101. The cosmetic product 100 includes a base 102, a track 108, an inner body 112, a shell 116, and a retention mechanism 120. In the illustrated examples, the cosmetic substance 101 is in the form of a lipstick or lip balm product. It is to be appreciated that the cosmetic substance 101 may be any type of cosmetic, hair care, body care, and/or skincare product that may be applied to a user. Other examples are possible. In some of these examples, the cosmetic substance 101 may include strong or otherwise aggressive chemicals and/or ingredients such as, for example, volatiles. The cosmetic substance 101 includes a first end 101*a*, a second end 101*b*, and an elongated body 101*c* extending therebetween along a longitudinal axis ("A"). Further, the cosmetic substance 101 defines an outer cross-sectional dimension ("DO"). In the illustrated examples, the outer cross-sectional dimension DO is in the form of an outer diameter or circumference. However, other examples are possible.

Generally speaking, the base 102 at least partially retains components of the cosmetic product 100 in a base cavity 103. The base cavity 103 defines a ledge 104 formed on an inner surface, and further includes a securement mechanism 105 formed on an outer surface thereof. The securement mechanism 105 may be used to engage a portion of a cap (not illustrated) to conceal the cosmetic substance 101 for storage purposes. Any number of suitable securement mechanisms 105 may be used such as, for example, a snap-fit coupling, friction-fit coupling, a threaded connection, and the like. Other examples are possible.

The track 108 is at least partially disposed within the base cavity 103 and includes a first end 108*a* and a second end 108*b* and defines a channel 109. The inner body (which, in some examples, may be referred to as an outer container) 112 is at least partially disposed within the base cavity 103 and includes an inner surface 113 and a notch 114. The shell 116 is also at least partially disposed within the base cavity 103 and is provided to prevent a user from observing these components. The shell 116 includes a lip 117 that engages a portion of the inner body 112 to restrict movement in a direction along the longitudinal axis A. It is to be appreciated that any of the base 102, the track 108, the inner body 112, and/or the shell 116 may include any number of additional features and/or components to assist in use of the cosmetic product 100, but for the sake of brevity, such features and/or components will not be discussed in substantial detail herein.

The retention mechanism 120 is provided to securely retain the cosmetic substance 101. The retention mechanism 120 includes a cup 122 having a cup body 124 and a liner 134. The cup body 124 includes a first end 124*a*, a second end 124*b*, an inner sidewall 124*c*, and a cup cavity 125. Generally speaking, the cosmetic substance 101 is at least partially disposed within the cup cavity 125 (by being disposed within a portion of the liner 134 as will be discussed below). The cup body 124 further includes a cup retention member 130. In some examples, the cup body 124 may be constructed from a non-swelling material.

Figure 2:
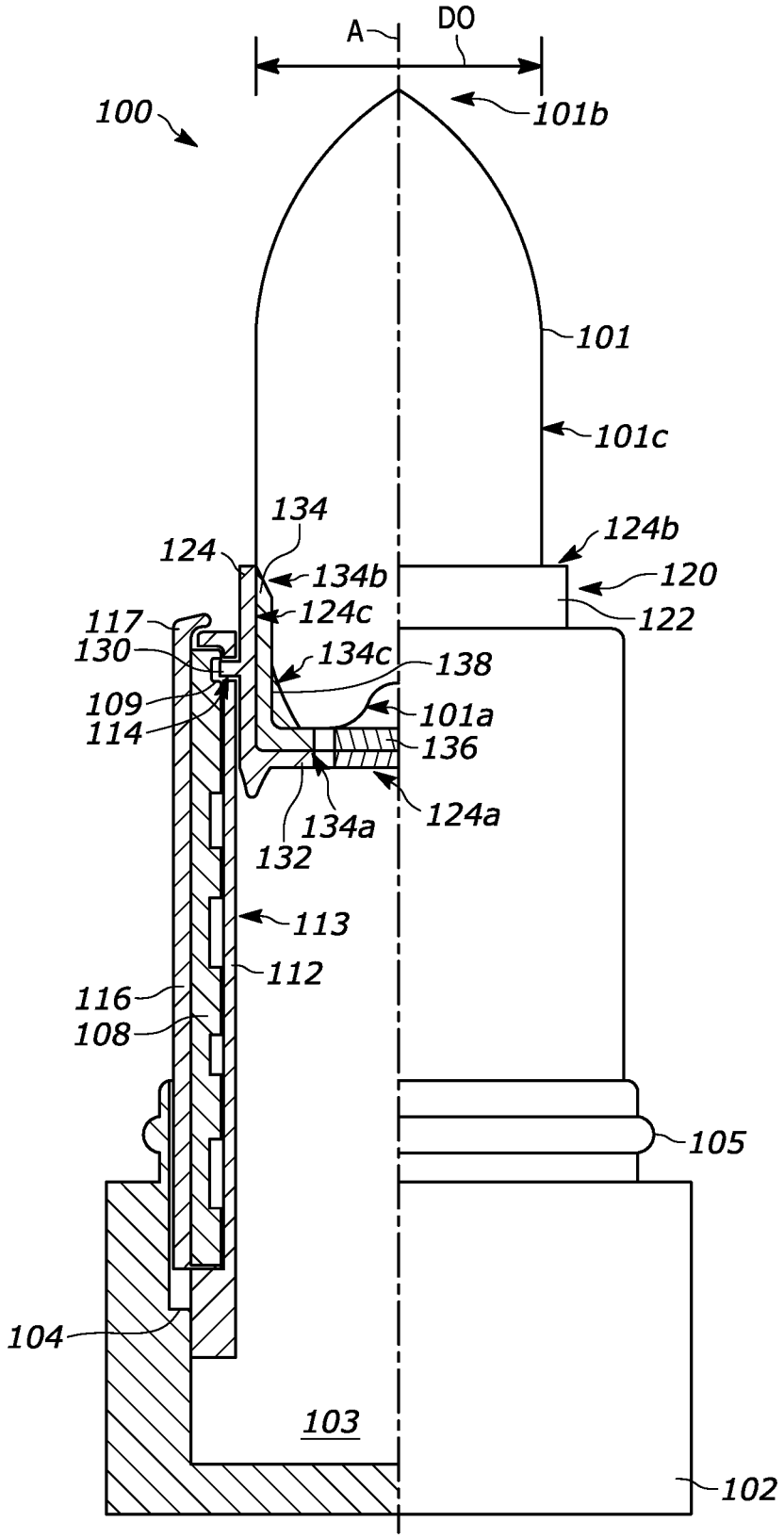
FIG. 2 illustrates a partial cross-sectional front elevation view of the example cosmetic product of FIG. 1 having an example retention mechanism in accordance with various examples.

With reference to FIG. 2, the cup body 124 is adapted to be disposed within the inner body 112. Upon coupling the cup body 124 with the inner body 112, the cup retention member 130 is positioned within the notch 114 of the inner body 112 to prevent or otherwise limit relative movement between the inner body 112 and the cup body 124. In some of these examples, such coupling between the inner body 112 and the cup body 112 may exert an inwardly-directed urging or compressive force. So arranged, both the first and second positioning notches 126, 128 extend inwardly into the cup cavity 125.

Figure 3:
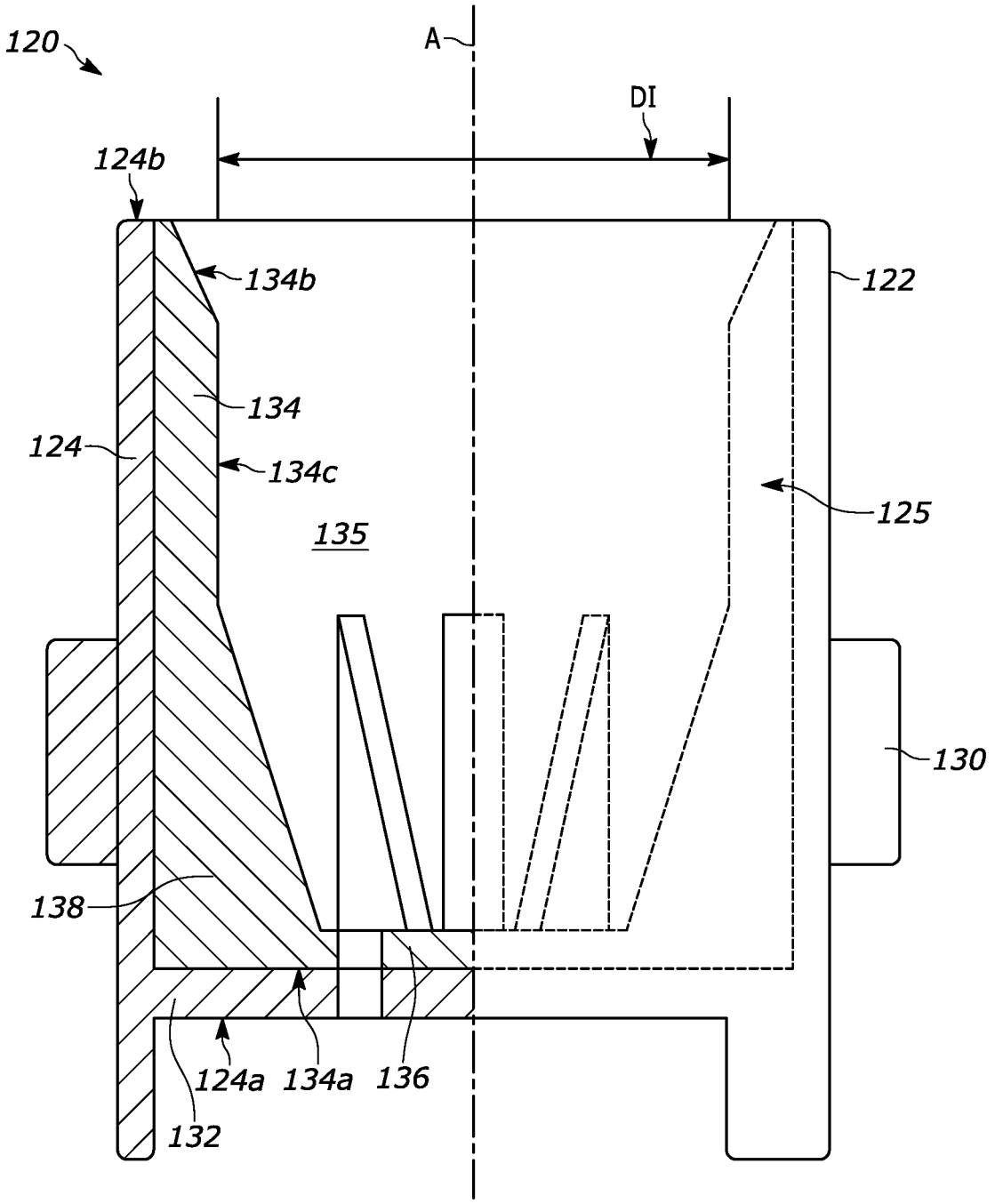
FIG. 3 illustrates a partial cross-sectional side elevation view of the example retention mechanism of FIGS. 1 & 2 in accordance with various examples.
Figure 4:
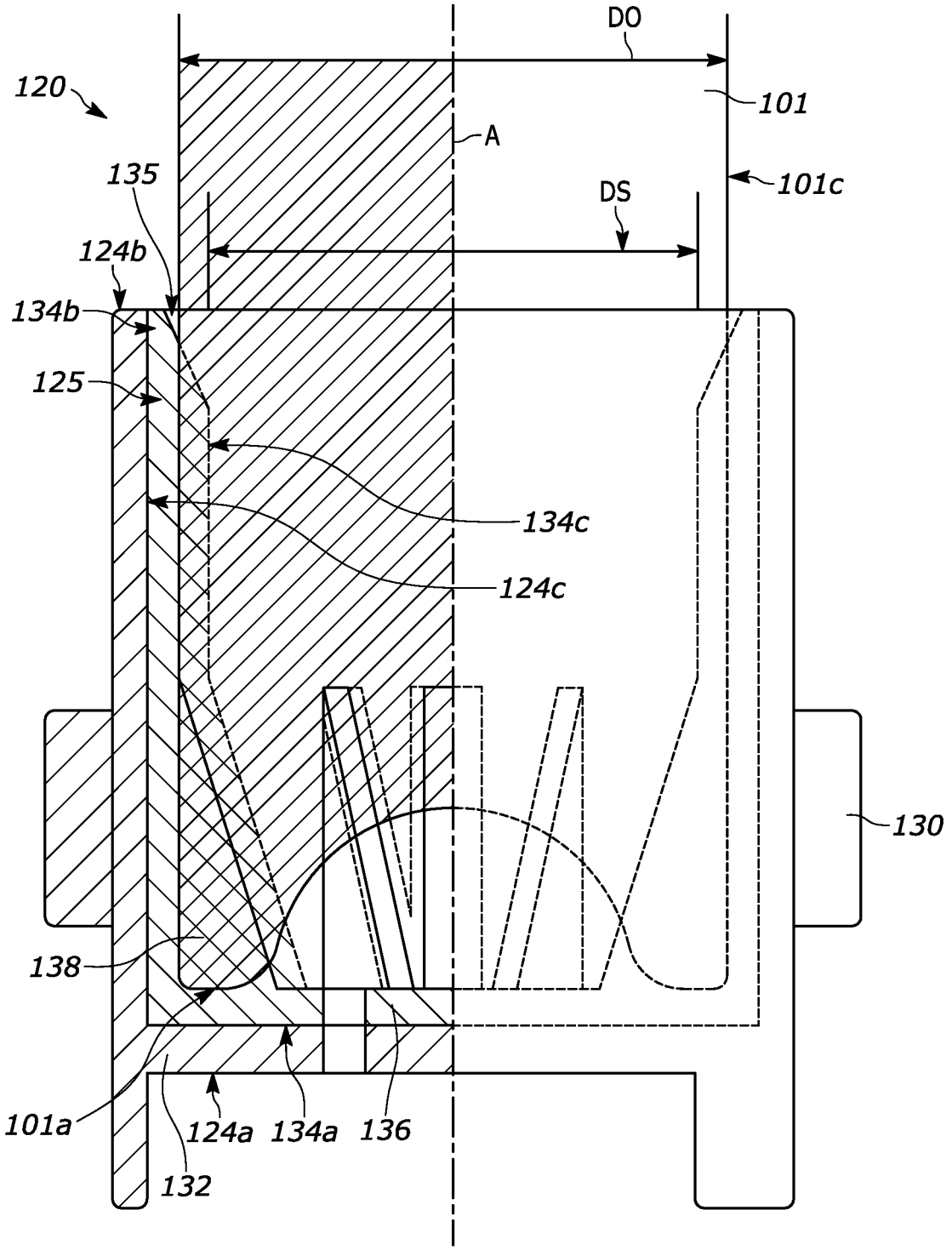
FIG. 4 illustrates a partial cross-sectional side elevation view of the example retention mechanism of FIG. 3 upon inserting a cosmetic substance therein in accordance with various examples.

The liner 134 is at least partially disposed or positioned within the cup cavity 125 and includes a first end 134*a*, a second end 134*b*, and an inner sidewall 134*c*. The inner sidewall 134*c* at least partially defines a liner cavity 135. As illustrated in FIGS. 2-4, the liner 134 is positionable adjacent to or near the first end 124*a* of the cup body 124, which, in examples where the cup body 124 includes a floor member, assists in preventing the liner 134 from advancing in a downward direction along the longitudinal axis A.

In some examples, the liner 134 may be formed separately or discretely from the cup body 124 and may be operably coupled therewith via any number of suitable approaches such as, for example, adhesives, a friction-fit connection, ultrasonic welding, and the like. Other examples are possible. Further, in some examples (not illustrated) the inner sidewall 124*c* of the cup body 124 may include a channel or other locating or retention mechanism to assist with alignment of the liner 134. In yet other arrangements, the liner 134 may be bi-injected with the cup body 124. As will be discussed, in some examples, the liner 134 is constructed from a different material than the cup body 124.

All or any desired portion of the liner 134 may be constructed from any number of swellable materials depending on the composition of the cosmetic substance 101. More specifically, the material used to form the liner 134 is selected based on whether a chemical reaction will occur upon coming into contact with the cosmetic substance 101. As a non-limiting example, if the cosmetic substance 101 includes isododecane, the liner 134 may be at least partially constructed from polyolefin. In other examples, if the cosmetic substance 101 includes castor oil, the liner 134 may be at least partially constructed from a synthetic rubber material including ethylene, propylene, and diene monomers (EPDM). In yet other examples, if the cosmetic substance 101 includes mannitol, the liner 134 may be at least partially constructed from silicone rubber. In any of these and other examples, the liner 134 is at least partially constructed from an "incompatible" material with respect to the composition of the cosmetic substance 101. Such "incompatibility"

between materials may generate swelling therebetween upon coming into contact with each other.

Due to the material "incompatibility" between the liner 134 and the cosmetic substance 101, the resulting chemical reaction therebetween may be exploited. More specifically, in these and other examples, the liner 134 may swell upon coming into contact with the cosmetic substance 101. As illustrated in FIG. 3, prior to contact between the liner 134 and the cosmetic substance 101, the liner 134 may define an initial inner cross-sectional dimension DI. As illustrated in FIG. 4, upon insertion or placement of the cosmetic substance 101 within the liner cavity 135, the liner 134 may define a swelled inner cross-sectional dimension DS. In some examples, the resulting swelling of the liner 134 may decrease the swelled inner cross-sectional dimension DS by between approximately 1% and approximately 10%, depending on respective material compositions. Other examples are possible. Put differently, prior to swelling due to contact between the inner sidewall 134*c* and the cosmetic substance 101, the liner cavity 135 may define a first volume, and after swelling due to contact between the inner sidewall 134*c* and the cosmetic substance 101, the liner cavity 135 may define a second volume. This second volume may be between approximately 1% and approximately 10% less than the first volume. Notably, because the liner 134 and the cup body 124 are constructed from different materials and because the cup body 124 may be constructed from a non-swelling material, upon the inner sidewall 134*c* coming into contact with the cosmetic substance 101, the direction of swelling of the liner 134 is constrained to a radial direction (i.e., into the liner cavity 135 and towards the longitudinal axis A).

To assemble the retention mechanism 120 and the cosmetic product 100, the liner 134 is inserted into the cup cavity 125 in examples where these components are discretely formed. It is to be appreciated that such placement is not necessary in examples where the liner 134 and the cup body 124 are formed via a bi-injection or other molding or forming process. In some approaches, the cup body 124 may then be coupled with the inner body 112 to thereby retain the cup body 124 in a relatively fixed position with respect to the longitudinal axis A. However, in other examples, the cup body 124 may not be coupled with the inner body 112 at this point.

As illustrated in FIG. 4, the first end 101*a* of the cosmetic substance 101 is then inserted into the liner cavity 135 and the cup cavity 125. In the illustrated example, the outer cross-sectional dimension DO of the cosmetic substance 101 is similar to the initial inner cross-sectional dimension DI of the liner 134, so such insertion of the cosmetic substance 101 will cause at least a portion of the elongated body 101*c* of the cosmetic substance 101 to contact the inner sidewall 134*c* of the liner 134. In some examples, the outer cross-sectional dimension DO of the cosmetic substance 101 may be less than to the initial inner cross-sectional dimension DI of the liner 134, but the elongated body 101*c* of the cosmetic substance 101 may be intentionally urged against the inner sidewall 134*c* of the liner 134 to initiate the chemical reaction, whereupon at least a part of the inner sidewall 134*c* will begin to swell, thereby reducing the volume of the liner cavity 135 to a point where additional regions of the inner sidewall 134*c* contact a portion of the elongated body 101*c*, which in turn will result in further swelling of the liner 134.

Accordingly, the inner sidewall 134*a* of the liner 134 applies a retaining force that squeezes or compresses against the elongated body 101*c* of the cosmetic substance 101. As previously noted, the resulting swelling of the liner 134 may decrease the swelled inner cross-sectional dimension DS by between approximately 1% and approximately 10%, depending on respective material compositions. Such an arrangement may ensure the liner 134 applies a compressive or retaining force against the cosmetic substance 101 when disposed therein. The "swellability" of the liner 134 described herein advantageously provides more retaining force than a system using a rigid or otherwise inflexible ring having a smaller dimension than that of the cosmetic substance 101. Further, such a rigid or otherwise inflexible ring having a smaller dimension than that of the cosmetic substance 101 would inherently damage or otherwise deform at least a portion of the cosmetic substance 101 upon being disposed within the ring.

It is to be appreciated that any number of characteristics such as, for example, any number of desired dimensions and/or material characteristics of the cosmetic substance 101 and the liner 101 may be modified to generate a relatively gentle or relatively firm compressive force against the cosmetic substance 101 without causing damage or deformation along the elongated body 101*c* due to the significant surface area contact between the ring 134 and the elongated body 101*c*. Further, the material properties of the cosmetic substance 101 and the liner 134 may be modified to alter the rate in which the liner 134 swells, thus ensuring the cosmetic substance 101 is not damaged or otherwise deformed during this step.

While the illustrated examples depict the liner 134 as encompassing or otherwise encircling an entire outer circumferential section of the elongated body 101*c* of the cosmetic substance 101, in some examples, the liner 134 may only encompass a portion of the entire outer circumferential section. Further, it is to be appreciated that if the cosmetic substance 101 is provided in other cross-sectional shapes (e.g., non-circular cross-sectional shapes), the liner 134 may have a similar non-circular cross-sectional shape.

In some examples, the liner 134 may include any number of optional features. For example, the liner 134 may include a floor member 136 positioned at the first end 134*a* thereof. This floor member 136 may provide additional support for the first end 101*a* of the cosmetic substance 101. Additionally, in some examples, the liner 134 may also include any number of elongated retention members 138. In the illustrated example, the elongated retention member 138 is aligned with the cup retention member 130, but in other examples, such components may not be aligned. The elongated retention member 138 may be in the form of an angled rib that extends or protrudes into the liner cavity 135. Upon inserting the cosmetic substance 101 into the cup cavity 135, the cosmetic substance 101 may at least partially encapsulate the elongated retention member 138, whereupon the elongated retention member 138 may restrict or otherwise limit rotation of the cosmetic substance 101 with respect to the liner cavity 135 about the longitudinal axis A. In some examples, the elongated retention member 138 may also be constructed from a swelling material, and as such, may swell upon coming into contact with the cosmetic substance 101. Such swelling may provide additional retention forces on the cosmetic substance 101 to assist with its retention within the liner cavity 135. It is to be appreciated that in some examples, the elongated retention member 138 may be constructed from either a different swelling material than the remainder of the liner 134 (or, in some examples, a different composition of the same material), and as such, may experience a different rate and magnitude of swelling with respect to the remainder of the liner 134.

With reference to FIG. 2, upon assembling the retention mechanism and the inner body 112, the cup retention member 130 (which, in some examples protrudes outwardly from the notch 114 of the inner body 112 is inserted into the channel 109 of the track 108. The lip 117 of the shell 116 may then be positioned over the inner body 112, and these components may then be inserted into the base cavity 103 of the base 102 until the shell 116 engages the ledge 104. In some examples, the shell 116, the track 108, and/or the inner body 112 may be fixed relative to the base 102 while the cup 122 may be rotatable relative thereto. As such, to advance the cosmetic substance 101, causing it to protrude outwardly beyond the shell 116, a user may twist the base to cause the cup retention member 130 to advance along the channel 109.

So configured, the retention mechanism and product described herein securely retains the cosmetic substance without damaging portions thereof. The retention mechanism advantageously exploits material incompatibilities, which were previously considered undesirable, to engage the cup with the cosmetic substance.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. Additionally, the described embodiments/examples/implementations should not be interpreted as mutually exclusive, and should instead be understood as potentially combinable if such combinations are permissive in any way. In other words, any feature disclosed in any of the aforementioned embodiments/examples/implementations may be included in any of the other aforementioned embodiments/examples/implementations.

The benefits, advantages, solutions to problems, and any element(s) that may cause any benefit, advantage, or solution to occur or become more pronounced are not to be construed as a critical, required, or essential features or elements of any or all the claims. The claimed invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus, the following claims are hereby incorporated into the Detailed Description, with each claim standing on its own as a separately claimed subject matter.

The patent claims at the end of this patent application are not intended to be construed under 35 U.S.C. § 112(f) unless traditional means-plus-function language is expressly recited, such as "means for" or "step for" language being explicitly recited in the claim(s).

What is claimed is:

1. A cosmetic product comprising:

a cup including:

a cup body having a first end, a second end, and forming a cup cavity, the cup body being formed from a first non-swelling material;

a liner at least partially disposed within the cup cavity, the liner having a first end, a second end, and an inner sidewall forming a liner cavity, the liner being constructed from a second material comprising a swellable material, and a cosmetic substance having a first end, a second end, and an elongated body therebetween, wherein at least a portion of the elongated body is adapted to be disposed within the liner cavity and contact a portion of the inner sidewall;

wherein upon disposing at least a portion of the cosmetic substance within the liner cavity, the liner is adapted to swell in a direction toward the cosmetic substance to apply a retaining force thereto.

2. The cosmetic product of claim 1, further comprising an outer container having a first end and a second end and defining a container cavity, wherein the cup is adapted to be at least partially disposed within the container cavity.

3. The cosmetic product of claim 1, wherein the liner is constructed from one of polyolefin, a synthetic rubber material including ethylene, propylene, and diene monomers (EPDM), or silicone rubber.

4. The cosmetic product of claim 3, wherein the liner is bi-injected with the cup body.

5. The cosmetic product of claim 1, wherein the liner is separately formed and operably coupled with the cup body.

6. The cosmetic product of claim 1, wherein the liner is adapted to surround an entire outer circumferential section of the cosmetic substance.

7. The cosmetic product of claim 1, wherein the liner comprises an elongated retention member disposed on the inner sidewall of the liner and extending into the liner cavity.

8. The cup of claim 7, further comprising a cup retention member disposed on an outer surface of the cup body.

9. The cup of claim 8, wherein the cup retention member is aligned with the elongated retention member.

10. The cosmetic product of claim 9, wherein the cup retention member is adapted to apply an urging force towards the cup cavity upon inserting the cup into the container cavity.

11. The cosmetic product of claim 1, wherein the liner further comprises a floor member positioned at or near the first end thereof, wherein the first end of the cosmetic substance is adapted to abut the floor member.

12. A retention mechanism for retaining a cosmetic substance, the retention mechanism comprising:

a cup body having a first end, a second end, and forming a cup cavity, the cup body being formed from a first non-swelling material; and a liner at least partially disposed within the cup cavity, the liner having a first end, a second end, and an inner sidewall forming a liner cavity, the liner being constructed from a second material comprising a swellable material;

wherein the liner is adapted to swell upon a cosmetic substance being placed within the liner cavity such that the liner applies a retaining force on the cosmetic substance to retain the cosmetic within the liner cavity.

13. The retention mechanism of claim 12, wherein the cup body is bi-injected with the liner.

14. The retention mechanism of claim 12, wherein the second material comprises one of polyolefin, a synthetic rubber material including ethylene, propylene, and diene monomers (EPDM), or silicone rubber.

15. The retention mechanism of claim 12, wherein the liner comprises an elongated retention member disposed on the inner sidewall of the liner and extending into the liner cavity.

16. A method of assembling a cosmetic product, the method comprising:

providing a cup including:

a cup body having a first end, a second end, and forming a cup cavity, the cup body being formed from a first non-swelling material;

a liner at least partially disposed within the cup cavity, the liner having a first end, a second end, and an inner sidewall forming a liner cavity, the liner being constructed from a second material comprising a swellable material, providing a cosmetic substance having a first end, a second end, and an elongated body therebetween; and disposing at least a portion of the elongated body of the cosmetic substance within the liner cavity such that the cosmetic substance contacts a portion of the inner sidewall;

wherein in response to the cosmetic substance contacting a portion of the inner sidewall, the liner is adapted to swell in a direction toward the cosmetic substance to apply a retaining force thereto.

17. The method of claim 16, wherein the cup is formed via a bi-injection process.

* * * * *